US005613315A

United States Patent [19]

Hunziker

[11] Patent Number: 5,613,315

[45] Date of Patent: Mar. 25, 1997

[54] FIRING PIN MECHANISM

[75] Inventor: Roger A. Hunziker, Conroe, Tex.

[73] Assignee: Phillips and Rodgers, Inc., Conroe, Tex.

[21] Appl. No.: 509,837

[22] Filed: Aug. 1, 1995

[51] Int. Cl.[6] ..... F41C 3/14; F41A 19/06

[52] U.S. Cl. ..... 42/65; 42/69.01

[58] Field of Search ..... 42/65, 69.01, 69.02, 42/69.03

[56] References Cited

U.S. PATENT DOCUMENTS

| | | | |
|---|---|---|---|
| 903,919 | 11/1908 | Torkelson | 42/65 |
| 2,805,604 | 9/1957 | Humphrey | 42/69.01 |
| 3,049,977 | 8/1962 | Reich | 42/65 |
| 3,176,423 | 4/1965 | Geber | 42/65 |
| 3,680,241 | 8/1972 | Ramsay | 42/69.01 |
| 3,708,902 | 1/1973 | Foster et al. | 42/69.01 |
| 3,733,730 | 5/1973 | Baker | 42/65 |
| 3,777,384 | 12/1973 | Ruger et al. | 42/65 |
| 4,221,065 | 9/1980 | Curran | 42/65 |
| 4,543,741 | 10/1985 | Phillips | 42/68 |
| 4,581,836 | 4/1986 | Baker et al. | 42/65 |
| 5,341,587 | 8/1994 | Phillips | 42/68 |

*Primary Examiner*—Michael J. Carone
*Assistant Examiner*—Theresa M. Wesson
*Attorney, Agent, or Firm*—Pravel, Hewitt, Kimball & Krieger

[57] ABSTRACT

A firing pin for a weapon is movably mounted in a pin bushing which is resiliently biased within a bushing guide. The bushing guide limits maximum forward travel of the pin bushing. The pin bushing is urged into a position of firm contact with the rear of the cartridge, but limited in its forward travel by the bushing guide. The tip of the firing pin is prevented from passing entirely through the primer when struck by the firing pin hammer. The mechanism insures more reliable firing, particularly if several different caliber shells are being fired.

11 Claims, 4 Drawing Sheets

FIRING PIN MECHANISM

BACKGROUND OF INVENTION

1. Field of Invention

The present invention relates to firing pin mechanisms for weapons.

2. Description of Prior Art

Commonly owned U.S. Pat. No. 5,341,587 is an example mechanism which permits proper cartridge seating in cartridge chambers of a single cartridge cylinder body for both rimmed and rimless types of cartridges. Mechanisms of this type were also useful for allowing shells of several different calibers to be fired from the same weapon, even from the same cartridge cylinder body.

Reliable firing operation in weapons of all types was very important, but particularly with weapons of this type. Problems have existed in the past with inaccurate firing pin movement. For example, if the firing pin were to travel too far forward, it could pass entirely through the primer in the cartridge, puncturing it. This could result in undesirable gas blow-back. Another potential problem with inaccurate firing pin movement was with the firing pin entering too deeply and getting stuck in the primer.

SUMMARY OF INVENTION

Briefly, the present invention provides a new and improved firing pin mechanism for weapons. It may be used with weapons capable of firing both rimmed and rimless cartridges, and also cartridges of different calibers. It is also useful with other types of revolvers and weapons.

A firing mechanism according to the present invention transfers the impact of a weapon firing hammer to a cartridge primer of a cartridge in a chamber of the weapon in order to fire the cartridge. The firing mechanism of the present invention includes a firing pin which has a tip extending from a body portion for engaging the primer under impact from the firing hammer. The firing pin also has a contact surface, located on its body portion opposite the tip, for receiving impact from the weapon firing hammer.

The firing mechanism of the present invention also includes a firing pin housing mounted in the weapon. The firing pin housing has a receiving chamber in which the firing pin body portion is mounted. An opening is formed in the receiving chamber adjacent the cartridge primer for passage of the firing pin tip outwardly towards the cartridge primer. The firing pin housing also includes a forward contact for engaging the cartridge for contact of the primer by the tip of the firing pin, and a stop shoulder which defines a limit of forward travel of the firing pin.

A resilient spring or other suitable mechanism is mounted between the firing pin and the firing pin housing. This mechanism serves the function of urging the firing pin rearwardly in the housing receiving chamber, in effect functioning as a return mechanism. The firing pin is returned into a position where the firing pin contact surface can again be struck by the weapon firing hammer after a previous firing contact is made.

The firing pin mechanism of the present invention also includes a bushing guide mounted in the weapon between the weapon firing hammer and the weapon cartridge chamber. The bushing guide has a housing chamber for receiving the firing pin housing, with an opening being formed in the housing chamber for passage of the forward contact of the firing pin housing. The bushing guide also includes a stop for engaging the outer stop shoulder on the firing pin housing to limit forward travel thereof to prevent excess travel and inaccurate firing.

DETAILED DESCRIPTION OF THE PREFERRED EMBODIMENT

Figure 2:
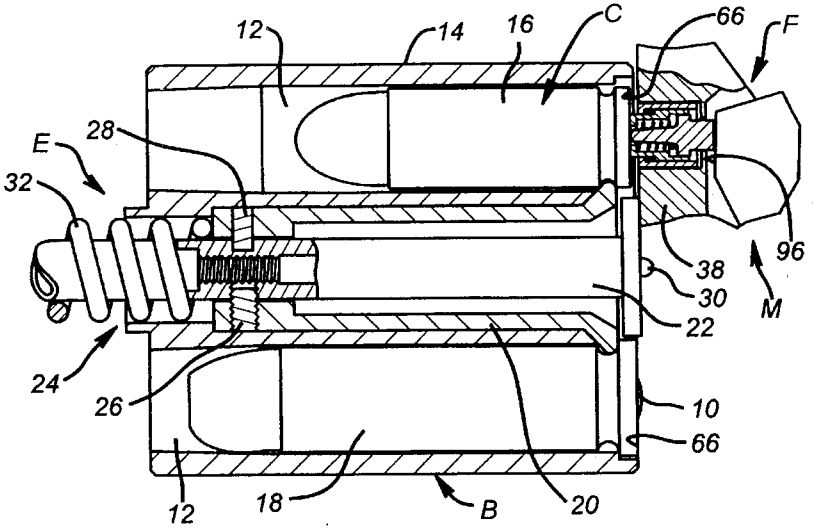
FIGS. 2 and 3 are elevation views, taken partly in cross-section, of the firing pin mechanism and revolver of FIG. 1.

In the drawings, the letter F designates generally a firing pin mechanism according to the present invention. The firing pin mechanism F is used to transfer the impact of a firing hammer M to a primer portion 10 of a shell or cartridge C in a cartridge chamber 12 in a cylinder body 14 of a revolver R. The firing pin mechanism F transfers such impact in order to cause the cartridge C to be fired.

Figure 3:
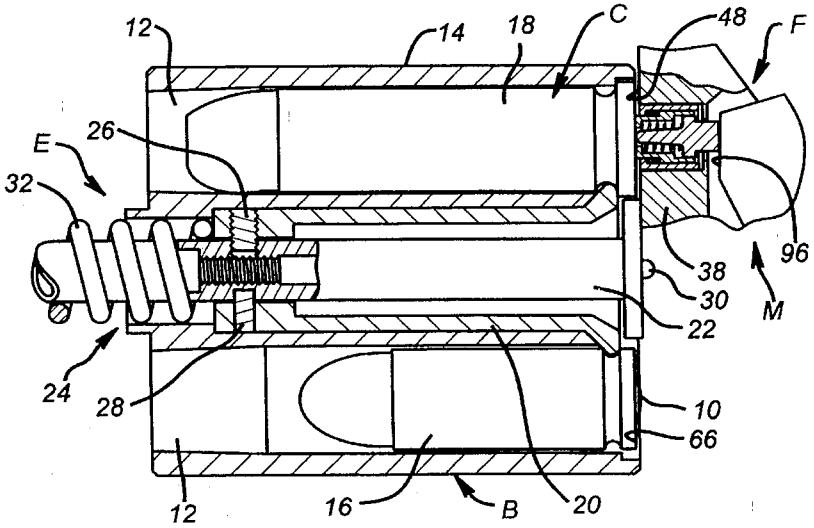
Figure 1:
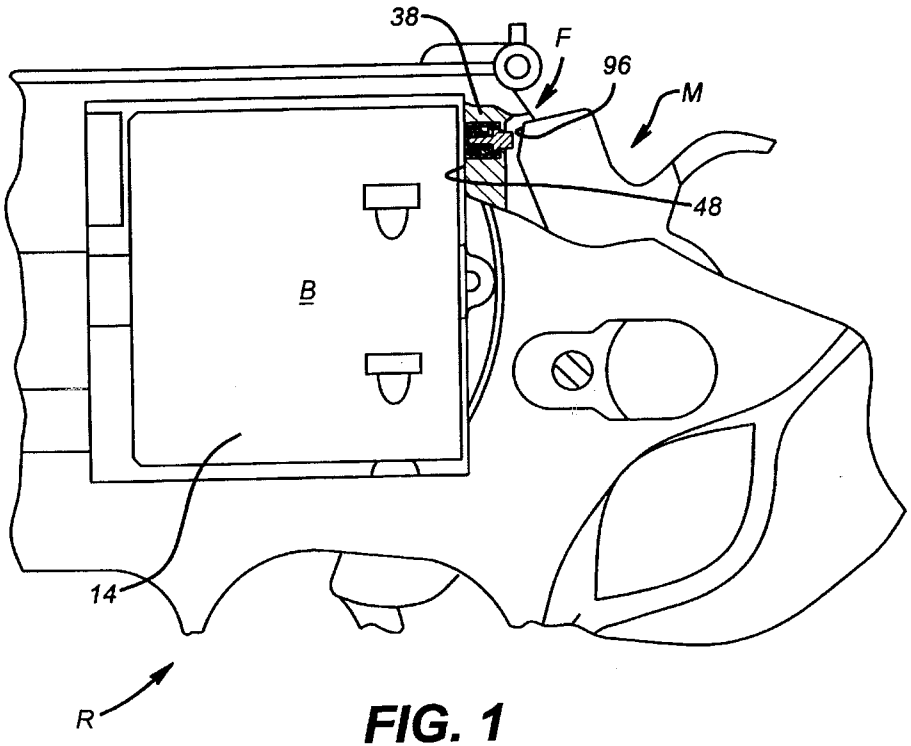
FIG. 1 is an elevation view, taken partly in cross-section, of portions of a revolver having a firing pin mechanism according to the present invention.
Figure 4:
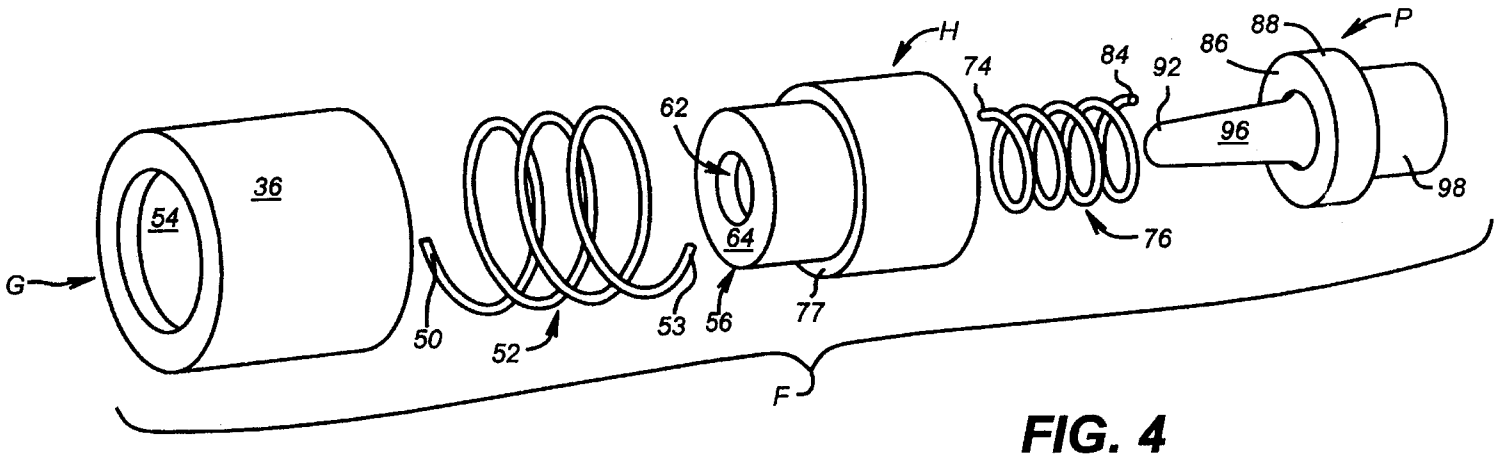
FIG. 4 is an exploded and enlarged isometric view of the firing pin mechanism of FIG. 1.
Figure 5:
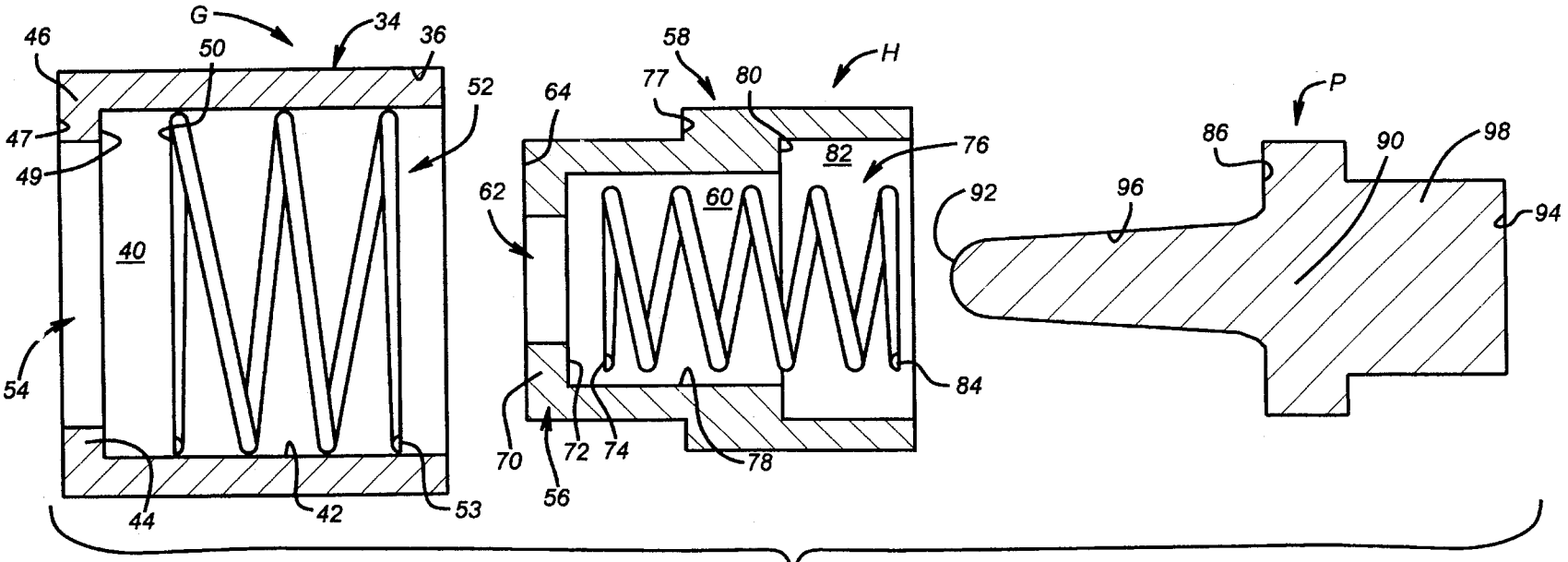
FIG. 5 is an exploded and enlarged elevation view, taken partly in cross-section, of the firing pin mechanism of FIGS. 1 and 4.
Figure 6:
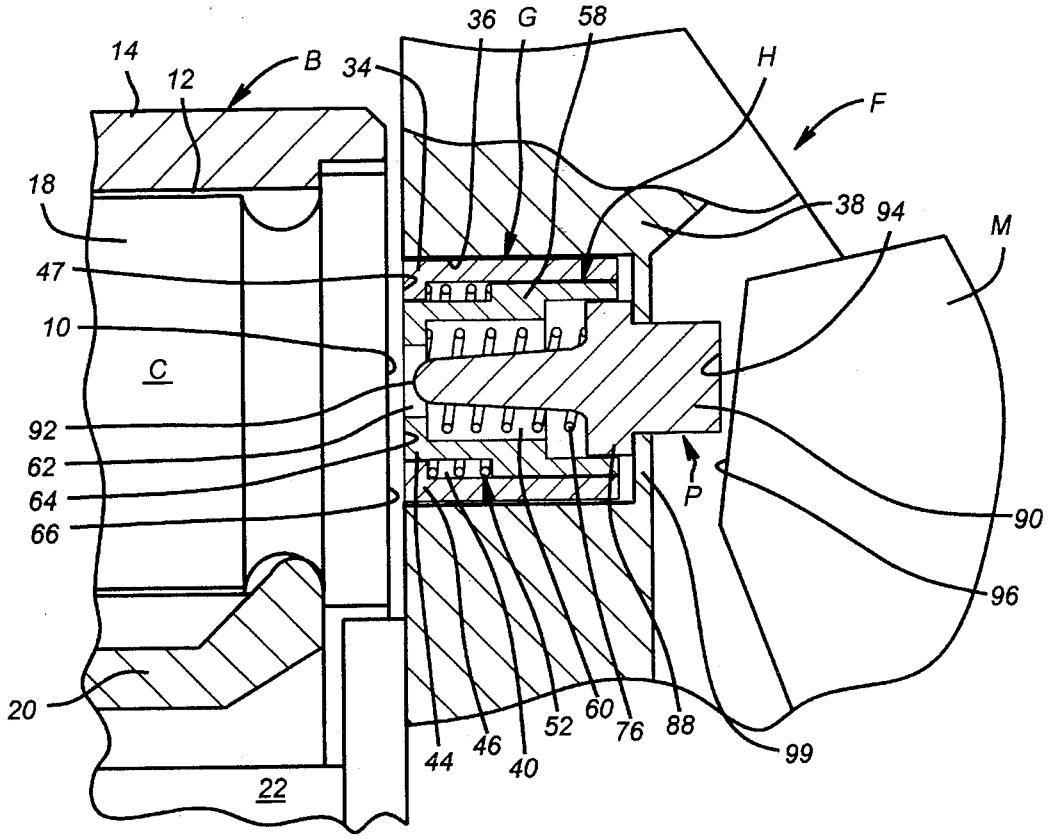
FIGS. 6, 7, 8 and 9 are enlarged elevation views, taken partly in cross-section, of the firing pin mechanism of FIG. 1 in various operating positions.
Figure 7:
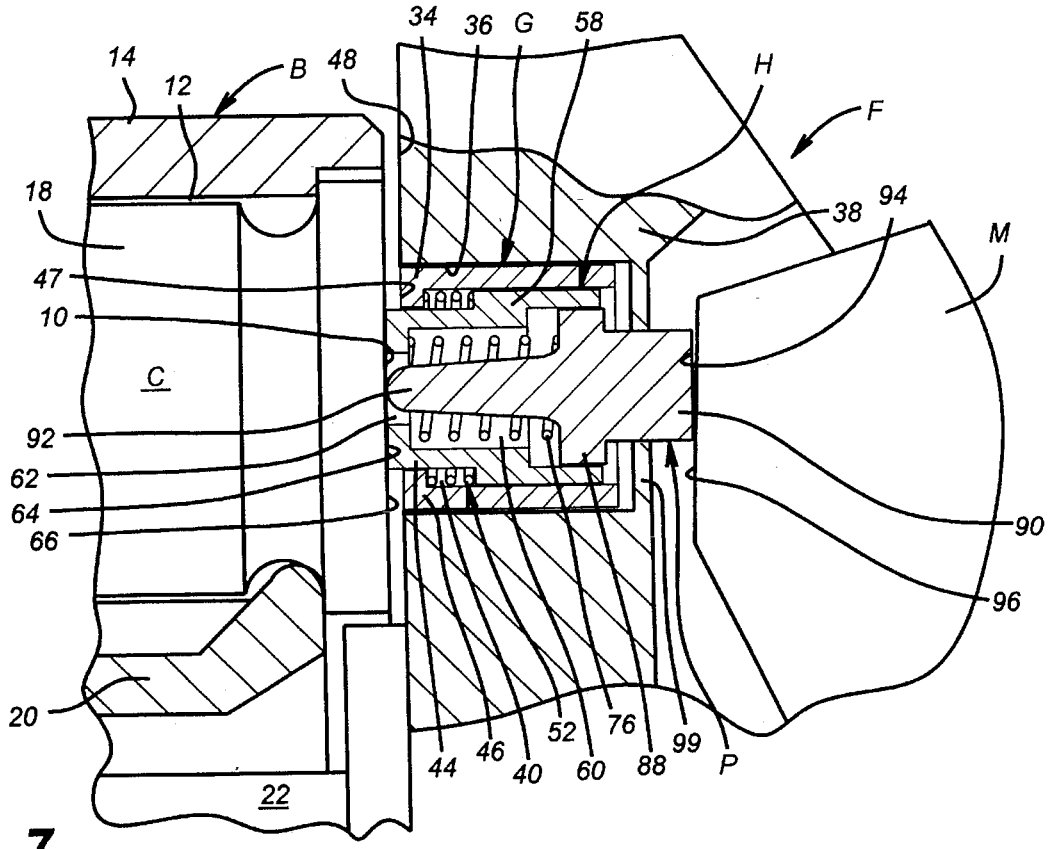
Figure 8:
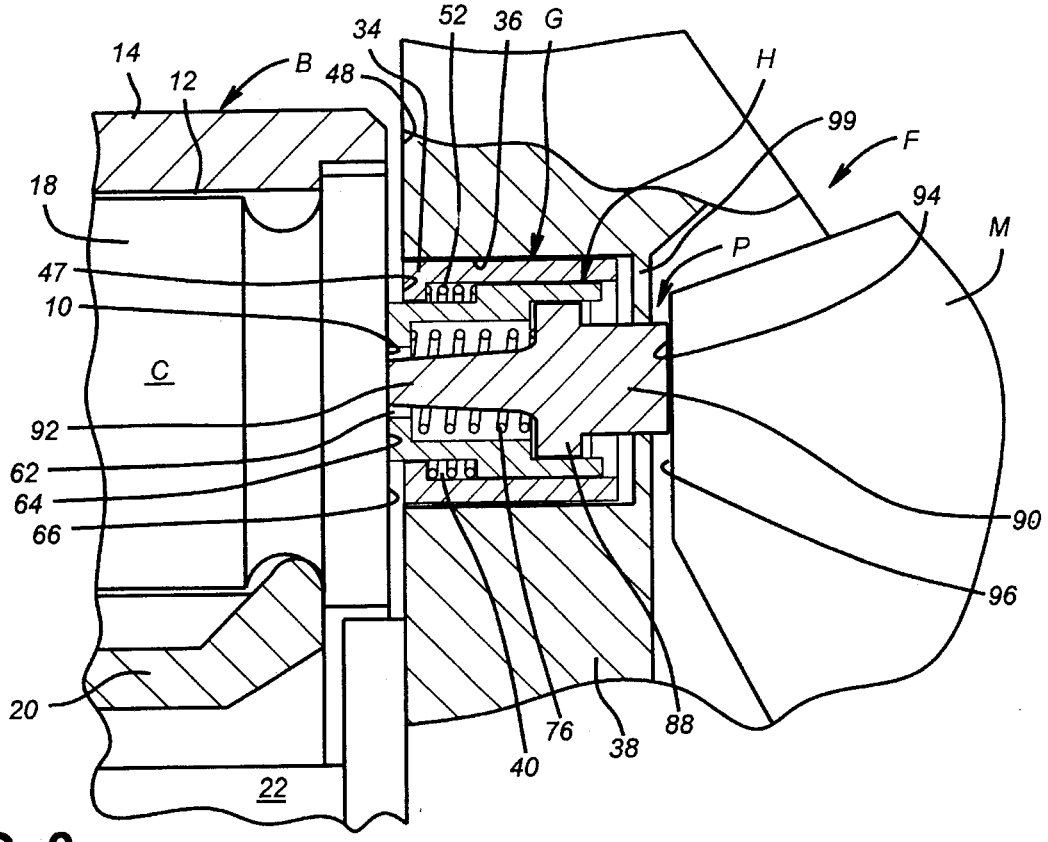

The firing pin mechanism F is particularly adapted for used in revolvers R which fire cartridges of different calibers or different lengths from the same cylinder body 14. Examples of such types of revolvers are in commonly owned U.S. Pat. Nos. 4,543,741 and 5,341,587, each of which is incorporated herein by reference. As can be seen in the drawings (FIGS. 2 & 3 ), a first shell 16 in the revolver cylinder body B is a rimless cartridge, while a second shell 18 is a rimmed cartridge. The position of cylinder body 14 has been adjusted between FIGS. 2 and 3 so that rimmed shell 18 is adjacent the firing pin mechanism F in FIG. 3.

In revolvers of this type, a casing ejector/positioning mechanism E is located in the revolver cylinder body 14. In the embodiment shown, the ejector/positioner mechanism E includes an ejector body 20 mounted over a rear portion 22 of an extractor rod 24 by a set screw 26 and a mounting pin 28. The extractor rod 24 includes a pivot pin 30 at a rear portion to mount the revolver cylinder body 14 in the revolver R.

A spring 32 of the type set forth in U.S. Pat. No. 5,341,587 extends forwardly from the ejector body 20 and the revolver cylinder body 14 of the revolver R. With the exception of the firing pin mechanism F according to the present invention, the remainder of the revolver R is of like structure and function to revolvers of this type, and accordingly only portions thereof are shown in the drawings.

The firing pin mechanism F (FIGS. 4 through 9, inclusive) includes a firing pin P, a firing pin housing H in which the firing pin P is mounted, and a bushing guide G in which the firing pin housing H is mounted. Each of the pin P, housing H, and guide G are formed from a suitable strength of weapon grade steel.

The bushing guide G is a generally cylindrical body member 34 which is press-fitted along an outer side wall 36 or otherwise suitably mounted in a frame or body portion 38 (FIGS. 6–9) of the revolver R between the hammer M and the revolver cylinder body 14. The cylindrical body 34 of the bushing guide G has an inner cylindrical housing chamber 40 (FIG. 5) formed adjacent an inner wall 42. A stop or shoulder 44 is formed extending inwardly from a forward portion 46 of the bushing guide body 34. An outer or front wall 47 of the body 34 extends (FIGS. 6–9) flush with and along a common surface with a forward wall 48 of the body 38 of the revolver R.

The stop 44 has a rear inner wall 49 (FIGS. 4 & 5) against which a forward end 50 of a helical spring 52 is adapted to be mounted. A rear end 53 of spring 52 is adapted to be fitted against the firing pin housing H. An opening or port 54 is formed in the housing guide body 34 adjacent the stop 44 so that a forward contact portion 56 of the firing pin housing H may pass therethrough.

The firing pin housing H is a generally cylindrical body member 58 mounted within the bushing guide G and having an internally formed receiving chamber 60. The receiving chamber 60 extends rearwardly from a front opening 62 formed in the forward contact portion 56 of the firing pin housing H.

The forward contact portion 56 includes a generally flat contact surface 64 formed about the opening 62. The contact surface 64 is adapted to be urged against a rear portion 66 (FIGS. 6–9, inclusive) of the cartridge C about the periphery of the primer portion 10 of the cartridge C.

The firing pin housing H also includes an inwardly extending collar 70 formed adjacent the opening 62 rearwardly of the contact surface 64. An inner wall 72 of the collar 70 serves as a seat for a forward end 74 of a coiled spring 76 mounted within the firing pin housing H. An outer annular seating surface 77 is formed on the firing pin housing H to serve as a seat for the rear end 53 of spring 52. The firing pin housing H also includes an intermediate inner wall 78 defining the receiving chamber 60 and extending rearwardly from the collar 70 to a stop shoulder 80 at an enlarged rear chamber 82.

The spring 76 extends rearwardly in the receiving chamber 60 and rear chamber 82 of the firing pin housing H about the firing pin P and has a rear portion 84 adapted to be seated against a forward seating surface 86 of a travel limiting collar 88 formed in an intermediate body portion 90 of the firing pin P. The firing pin P includes a tip 92 located forward of the body portion 90 and a rear contact surface 94. The rear contact surface 94 of the firing pin P is adapted to be contacted by a contact surface 96 of the hammer M of the revolver R when the revolver is fired in the conventional manner by pulling its trigger. The tip 92 of the firing pin P extends forwardly from the body portion 90 and is adapted to transfer impact which is received at the contact surface 94 from the hammer H through to the primer 10 of the cartridge C.

The firing pin P tapers outwardly rearwardly from the tip 92 along a conical surface 96 (FIGS. 4 & 5) to the seating surface 86 of the collar 88. The collar 88 is of a size to fit within the rear chamber 82 of the firing pin housing H. However, the travel limit collar 88 is limited in forward movement by the stop shoulder 80 of the firing pin housing H.

The firing pin P also has a rear body portion 98 extending rearwardly from the collar 88 to the contact surface 94. The frame 38 of the revolver R includes a rear retainer wall 99 which serves as a rear limit of movement of the travel limit collar 88 of the firing pin P. In its normal position prior to contact by the hammer surface 96 (FIG. 6), the rear contact surface 94 of firing pin P extends outwardly from a rear wall 99 of the frame 38 an adequate distance to insure contact by the hammer surface 96, usually approximately 0.050".

In the operation of the present invention, the hammer M of revolver R is moved to fire in the conventional manner. The hammer M moves forward and its contact surface 96 hits the rear contact surface 94 (FIG. 7) of the firing pin P, causing the firing pin P to move forward until its surface 86 contacts stop shoulder 80 of the firing pin housing H. At this point, the tip 92 of the firing pin P extends forward from the opening 62 of the housing H an adequate distance to insure firing contact with cartridge primer 10, typically about 0.020".

Figure 9:
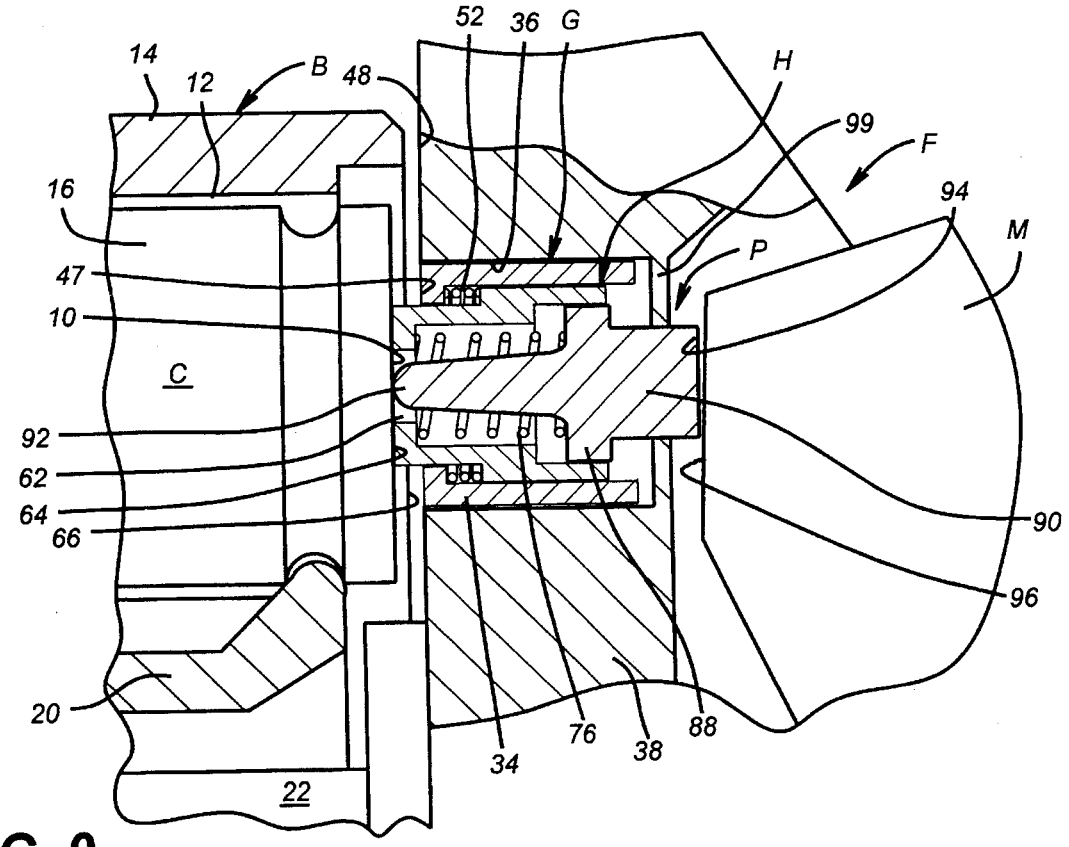

The firing pin housing H moves forward until its contact surface 64 engages the primer portion 10 of the cartridge C, and the tip 62 of the firing pin P strikes the cartridge primer 10 (FIG. 8), causing the cartridge C, in this case a rimmed cartridge 18, to fire. It is to be noted that the firing pin housing H of the mechanism P also can travel further forward so that it in almost all cases it may make contact with a rimless cartridge 16 (FIG. 9). Thus, the surface 64 can move adequately forward so that it makes contact with primer portion 10, even though the cartridge 16 is further recessed in the cylinder body B. For deeply recessed cartridges, the firing pin housing H extends adequately forward so that firing contact with primer 10 occurs, even if the surface 64 does not contact the cartridge.

Forward movement of the firing pin tip 62 within the housing H insures that firing contact is made with the cartridge primer 10. This is a particularly advantageous feature when the revolver R is capable of firing any of several calibers of cartridges and both rimmed and rimless shells. It also serves to prevent the firing pin P from penetrating the primer 10 and sticking there. Additionally, the possibility of gas blow-back from a perforated primer 10 is substantially overcome.

The springs 52 and 76 serve to return the firing pin housing H rearwardly after the cartridge C has been fired. When the pressure of hammer M on firing pin P is removed, the spring 76 initially moves the firing pin P rearwardly in the housing H and out of contact with the primer 10. The spring 52 moves the firing pin housing H rearwardly into its rest position (FIG. 6) in the bushing G.

Having described the invention above, various modifications of the techniques, procedures, material and equipment will be apparent to those in the art. It is intended that all such variations within the scope and spirit of the appended claims be embraced thereby.

I claim:

1. A weapon firing mechanism for transferring the impact of a weapon firing hammer to a cartridge primer in a weapon cartridge chamber of the weapon for firing the cartridge, comprising:

a firing pin having a tip extending from a body portion for engaging the primer under impact from the firing hammer and a contact surface on said body portion opposite said tip for receiving impact from the weapon firing hammer;

a firing pin housing movably mounted in the weapon, said firing pin housing having:

a receiving chamber for mounting said firing pin body portion therein;

an opening in said receiving chamber adjacent the cartridge primer for passage of said tip of said firing pin outwardly towards the cartridge primer;

a forward contact for engaging the cartridge for contact of the primer by said firing pin tip; and a stop shoulder defining a limit of forward travel of said firing pin;

resilient means mounted between said firing pin and said firing pin housing for urging said firing pin rearwardly in said receiving chamber into position for engagement of said contact surface by the weapon firing hammer after engagement of the cartridge primer by said firing pin tip; and a bushing guide mounted in the weapon between the weapon firing hammer and the weapon cartridge chamber, said bushing guide having:

a housing chamber for receiving said firing pin housing therein;

an opening in said housing chamber for passage of said forward contact of said firing pin housing; and a stop for engaging said stop shoulder of said firing pin housing for limiting forward travel of said firing pin housing.

2. The weapon firing mechanism of claim 1, further including:

biasing means for urging said firing pin housing rearwardly away from the weapon cartridge chamber in the absence of impact of the weapon firing hammer on the firing pin.

3. The weapon firing mechanism of claim 1, wherein the weapon is a revolver.

4. The weapon firing mechanism of claim 1, further including:

a travel limit collar formed on said firing pin in a portion thereof between said tip and said contact surface.

5. The weapon firing mechanism of claim 4, further including:

an inner limit shoulder formed in said receiving chamber of said firing pin housing to engage said travel limit collar of said firing pin to limit excess travel of said firing pin.

6. The weapon firing mechanism of claim 1, wherein:

said bushing guide is fixedly mounted in the weapon adjacent the weapon cartridge chamber of the weapon.

7. In a revolver from which cartridges of different calibers are capable of being fired from cartridge chambers under impact of a firing hammer, the improvement comprising:

a firing pin having a tip extending from a body portion of engaging the primer under impact from said firing hammer and a contact surface on said body portion opposite said tip for receiving impact from firing hammer;

a firing pin housing movably mounted in said revolver, said firing pin housing having:

a receiving chamber for mounting said firing pin body portion therein;

an opening in said receiving chamber adjacent the cartridge primer for passage of said tip of said firing pin outwardly towards the cartridge primer;

a forward contact surface for engaging the cartridge for contact of the primer by said firing pin tip; and a stop shoulder defining a limit of forward travel of said firing pin;

resilient means mounted between said firing pin and said firing pin housing for urging said firing pin rearwardly in said receiving chamber into position for engagement of said contact surface by said firing hammer after engagement of the cartridge primer by said firing pin tip; and a bushing guide mounted in the weapon between said firing hammer and said cartridge chambers, said bushing guide having:

a housing chamber for receiving said firing pin housing therein;

an opening in said housing chamber for passage of said forward contact of said firing pin housing; and a stop for engaging said stop shoulder of said firing pin housing for limiting forward travel of said firing pin housing.

8. The weapon firing mechanism of claim 7, further including:

biasing means for urging said firing pin housing rearwardly away from the weapon cartridge chamber in the absence of impact of the weapon firing hammer on the firing pin.

9. The weapon firing mechanism of claim 7, further including:

a travel limit collar formed on said firing pin in a portion thereof between said tip and said contact surface.

10. The weapon firing mechanism of claim 9, further including:

an inner limit shoulder formed in said receiving chamber of said firing pin housing to engage said travel limit collar of said firing pin to limit excess travel of said firing pin.

11. The weapon firing mechanism of claim 7, wherein:

said bushing guide is fixedly mounted in the weapon adjacent the weapon cartridge chamber of the revolver.

* * * * *